United States Patent [19]
Frey et al.
[11] 4,229,124
[45] Oct. 21, 1980

[54] AUTOMATIC ROOF BOLTING SYSTEM FOR MINES

[75] Inventors: G. Robert Frey; Joseph Parrotto; Francis X. Fontaine, all of Franklin, Pa.

[73] Assignee: Joy Manufacturing Company, Pittsburgh, Pa.

[21] Appl. No.: 12,429

[22] Filed: Feb. 15, 1979

[51] Int. Cl.[2] ..... E21D 11/00

[52] U.S. Cl. ..... 405/303; 173/22; 405/260; 414/22

[58] Field of Search ..... 405/259, 260, 261, 262, 405/303, 232; 173/43, 29, 31, 22, 35; 29/809, 811, 813; 206/219; 414/22, 745, 743, 10, 728; 175/315

[56] References Cited

U.S. PATENT DOCUMENTS

| | | | |
|---|---|---|---|
| 2,256,012 | 9/1941 | Blair | 29/813 X |
| 2,738,081 | 3/1956 | Lee | 173/22 X |
| 3,218,893 | 11/1965 | Madison et al. | 173/43 X |
| 3,506,075 | 4/1970 | Attebo | 414/22 X |
| 3,902,561 | 9/1975 | Friberg et al. | 414/22 X |
| 3,913,754 | 10/1975 | Swartz et al. | 414/22 |
| 4,158,520 | 6/1979 | Prebensen | 405/260 |

FOREIGN PATENT DOCUMENTS

| | | | |
|---|---|---|---|
| 1359297 | 3/1964 | France | 405/259 |

*Primary Examiner*—Dennis L. Taylor
*Attorney, Agent, or Firm*—Thomas H. Murray

[57] ABSTRACT

A roof bolting system for mines wherein a drill, a resin cartridge, a roof bolt cartridge and a roof bolt feed mechanism are carried on a single indexable head at the end of a boom extending outwardly from an operator's car or carriage. In a roof-bolting operation, the head is initially indexed to a position where the drill bores a hole in the roof of the mine. Thereafter, the head is indexed to the next position wherein a resin cartridge is fed into the drilled hole. Finally, the head is indexed to a third position where a roof bolt is fed into the resin-filled hole and tightened. Thereafter, the head is returned to its original position where the three steps are repeated. A resin cartridge and a bolt cartridge are provided for storing resin tubes and roof bolts such that the respective operations can be carried out automatically without the necessity for having an operator directly beneath the unsupported roof where the roof-bolting operation is occurring.

9 Claims, 8 Drawing Figures

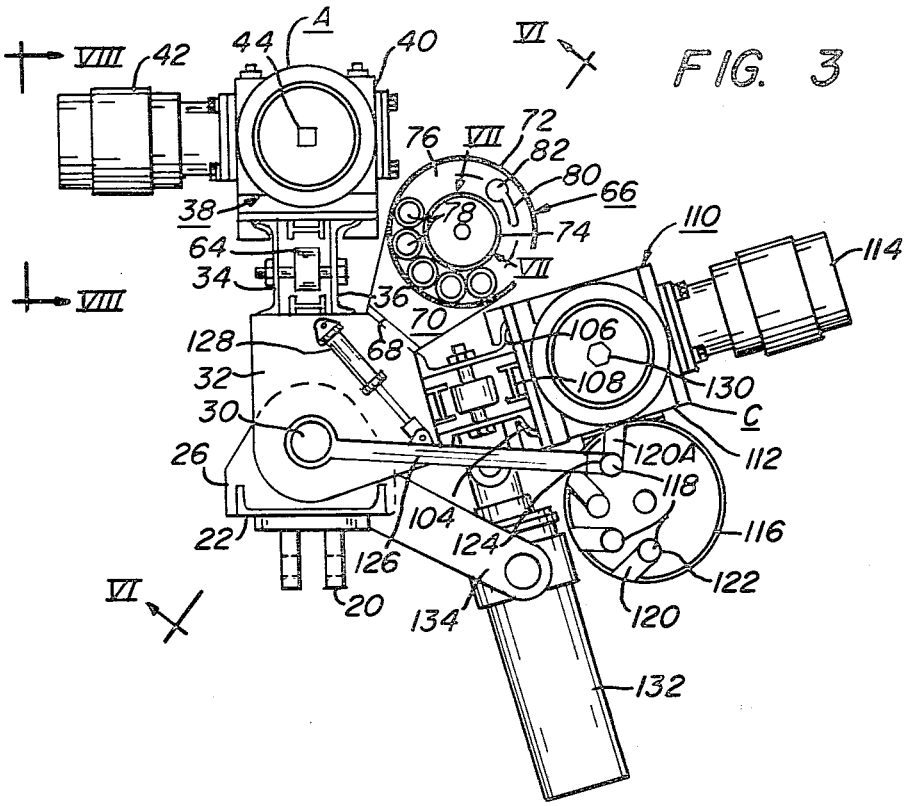
FIG. 3
FIG. 4
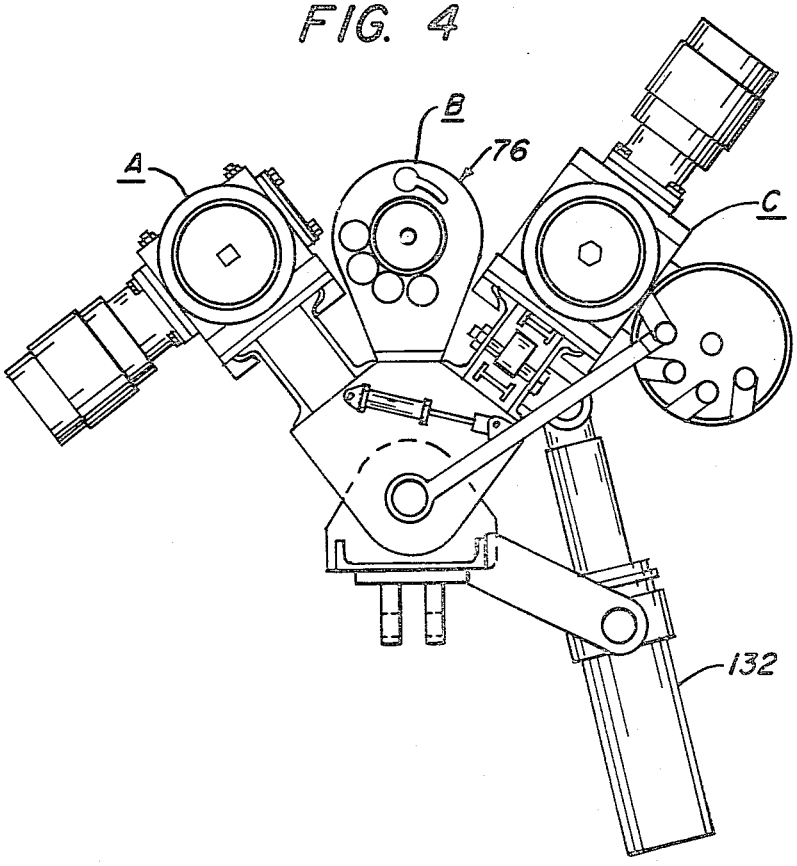

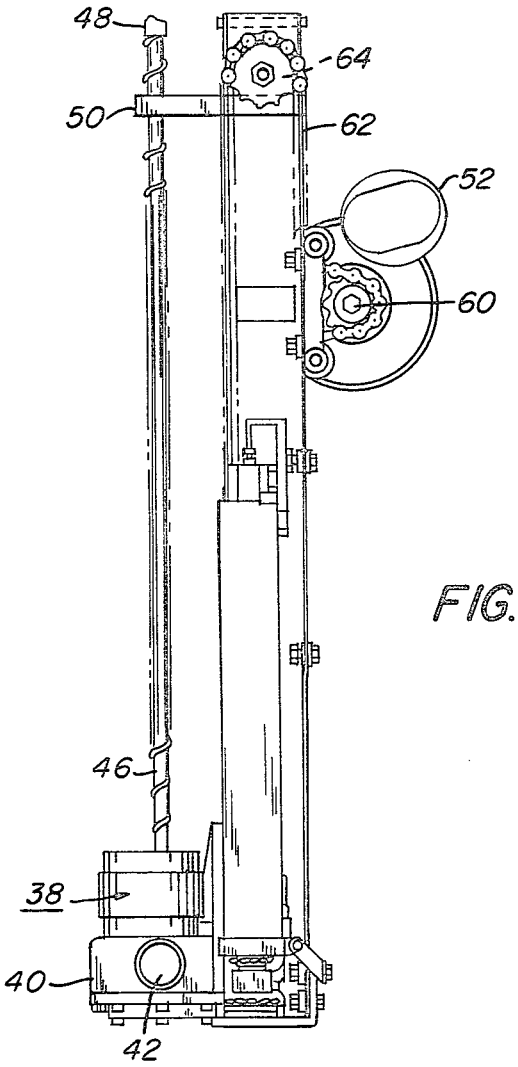
FIG. 8
FIG. 7
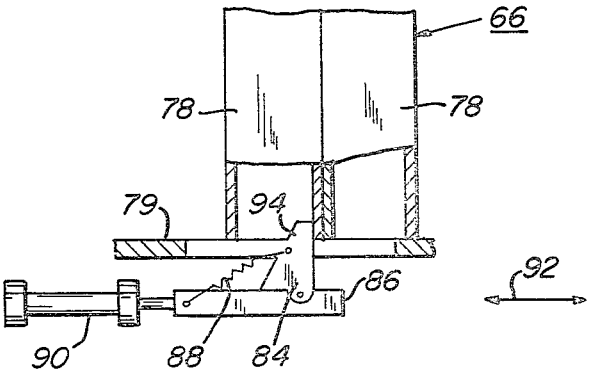

AUTOMATIC ROOF BOLTING SYSTEM FOR MINES

BACKGROUND OF THE INVENTION

In mines, the mine roof is ordinarily supported with roof bolts which are inserted into long holes drilled with a drill auger. These roof bolts are provided at their bottoms with plates that are held tight against the roof surface by a bolthead or nut. In some instances, a roof bolt is secured in place at its upper end by means of an expansible device threaded onto the upper end of the bolt. This is caused to expand upon rotation of the roof bolt and engage the sides of the drill hole where the roof bolt is located. However, instead of using an expansible member at the upper end of the roof bolt, it is also possible to secure the roof bolt within a drilled hole by means of a resin. When a roof bolt is secured in place by means of a resin, a frangible cartridge containing a synthetic resin-based composition is first inserted into a hole drilled into the mine roof for reception of the roof bolt. The frangible cartridge is destroyed by rotating the roof bolt in the hole while in contact with the cartridge so as to cause the contents of the cartridge to be mixed and displaced into the annular space between the roof bolt and the wall of the drilled hole. Curing of the synthetic resin takes place in situ with the result that the roof bolt, which carries a plate at its lower end, is secured within the hole.

In the past, it has been more or less common to manually insert resin-secured roof bolts in place. That is, the drilling operation is performed by a rotation unit attached to one end of a boom arm carried on a rubber-wheeled carriage or the like. The rotation unit rotatably supports a drill bit which is forced upwardly into the mine roof as it is rotated. Once the hole is drilled, an operator manually inserts resin tubes up into the hole. Thereafter, the operator replaces the drill bit with a roof bolt on the rotation unit; and the roof bolt is then driven up into the hole such that it punctures the frangible resin cartridge to permit the resin to cure and hold the roof bolt in place.

One disadvantage of the prior art roof bolting operation described above is the necessity for the machine operator to perform various roof-bolting operations immediately beneath an unsecured portion of the mine roof. Until the roof bolt is inserted into the drilled hole and secured in place, it is possible for a portion of the mine roof to drop and cause injury to the roof bolt operator. Furthermore, an operation of this type requires a great deal of manual labor and is slow and cumbersome.

SUMMARY OF THE INVENTION

In accordance with the present invention, new and improved mine roof bolting apparatus for resin-supported roof bolts is provided which eliminates the necessity for having an operator manually interchange a roof drill for a roof bolt on a rotary drilling apparatus and which also eliminates the need for an operator to manually stuff resin cartridges up into a drilled hole. In this way, the operator can carry out the entire roof-bolting operation from an operator's car or carriage which is removed from the area where roof falls can occur and which carries the automatic roof bolting apparatus of the invention at the remote end of an adjustable boom.

Specifically, there is provided a mine roof bolting apparatus comprising (1) support means such as a boom, (2) an indexing device mounted on the end of the boom for rotation about an axis extending generally parallel to a roof bolt to be inserted into a mine roof, (3) drilling apparatus carried on the indexing device and adapted to force a drill up into the mine roof to form a drill hole for the reception of a roof bolt, (4) resin cartridge insertion apparatus carried on the indexing device and adapted to insert a resin cartridge into a drilled hole in a mine roof, (5) roof bolt insertion apparatus carried on the indexing device and adapted to insert a roof bolt into which has been drilled in a mine roof and into which a resin cartridge has been inserted, and (6) apparatus for actuating the indexing device to initially index a drill into alignment with the axis of a hole to be drilled and thereafter successively index said cartridge insertion device and said roof bolt insertion apparatus into alignment with the drilled hole.

In the preferred form of the invention, the resin cartridge insertion apparatus includes a rotatable canister which carries a plurality of resin cartridges, together with means for indexing each cartridge in succession toward a hydraulically-actuated plunger which forces the cartridge up into a drilled hole. Likewise, the roof bolt insertion apparatus includes a canister or magazine which successively aligns each of the plurality of roof bolts with a power-driven rotary drive which moves upwardly to force the roof bolt into a resin-filled hole.

The above and other objects and features of the invention will become apparent from the following description taken in connection with the accompanying drawings which form a part of this specification, and in which:

FIG. 3 is a top view of the rotary indexing apparatus of the invention which carries the drilling unit, the resin unit and the roof bolt insertion unit, the indexing unit being shown in position for drilling the initial hole in a mine roof;

FIG. 4 is a view similar to that of FIG. 3 but showing the indexing apparatus in position for inserting a resin cartridge into a hole in a mine roof which has been previously drilled;

FIG. 7 is a cross-sectional view taken substantially along line VII—VII of FIG. 3 showing the details of the actuating mechanism for the canister shown in FIG. 6; and FIG. 8 is a view taken substantially along line VIII—VIII of FIG. 3 showing in side elevation the drilling apparatus carried on the indexing mechanism of the invention.

Figure 2:
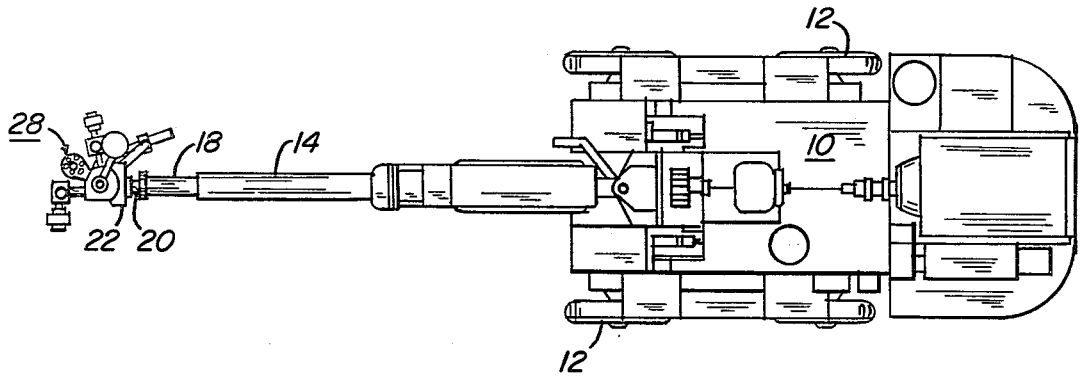
FIG. 2 is a top view of the apparatus shown in FIG. 1.
Figure 1:
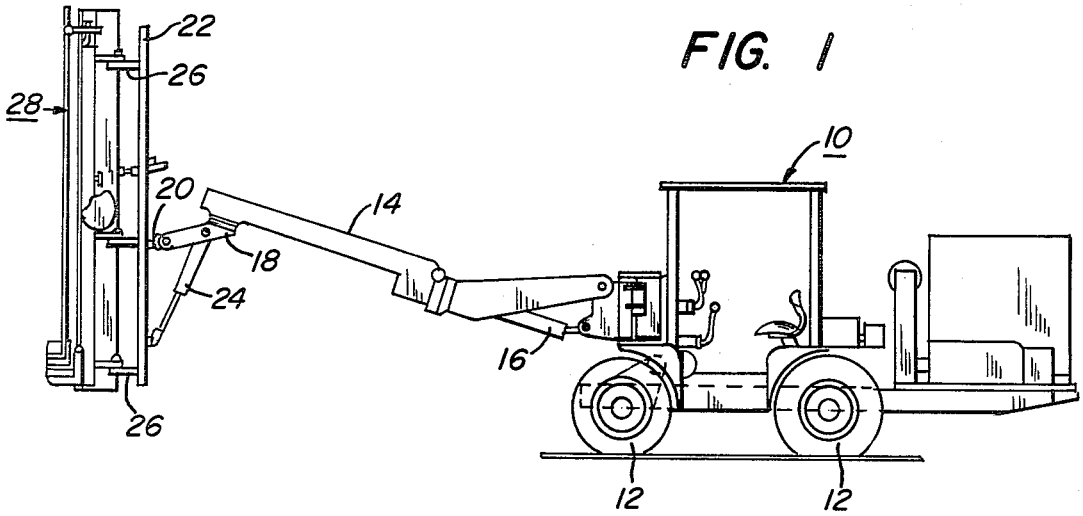
FIG. 1 is an elevational side view of the roof bolting apparatus of the present invention carried on the end of a boom extending outwardly from an operator's car.

With reference now to the drawings, and particularly to FIGS. 1 and 2, there is shown an operator's carriage 10 mounted on rubber wheels 12 which carries at its forward end a boom 14. The boom 14 can be elevated or lowered by means of a hydraulic cylinder 16 (FIG. 1)

and may also be rotated about its own axis by suitable manipulating apparatus, not shown. At the forward end of the boom 14 is a swivel 18 connected through a clevis 20 to an upright channel-shaped support member 22. (See also FIG. 3). Pivotally connected between the swivel 18 and the lower end of the channel member 22 is a hydraulic cylinder 24 adapted to pivot the support channel 22 about the clevis 20. Thus, by manipulation of the cylinders 16 and 24, and by rotating the boom 14 about its axis, the channel support member 22 can be rotated into any angular position in three dimensions.

Projecting outwardly from the channel support member 22 are supports 26 on which is mounted the three-position indexing apparatus of the present invention, generally indicated by the reference numeral 28 in FIGS. 1 and 2.

Figure 5:
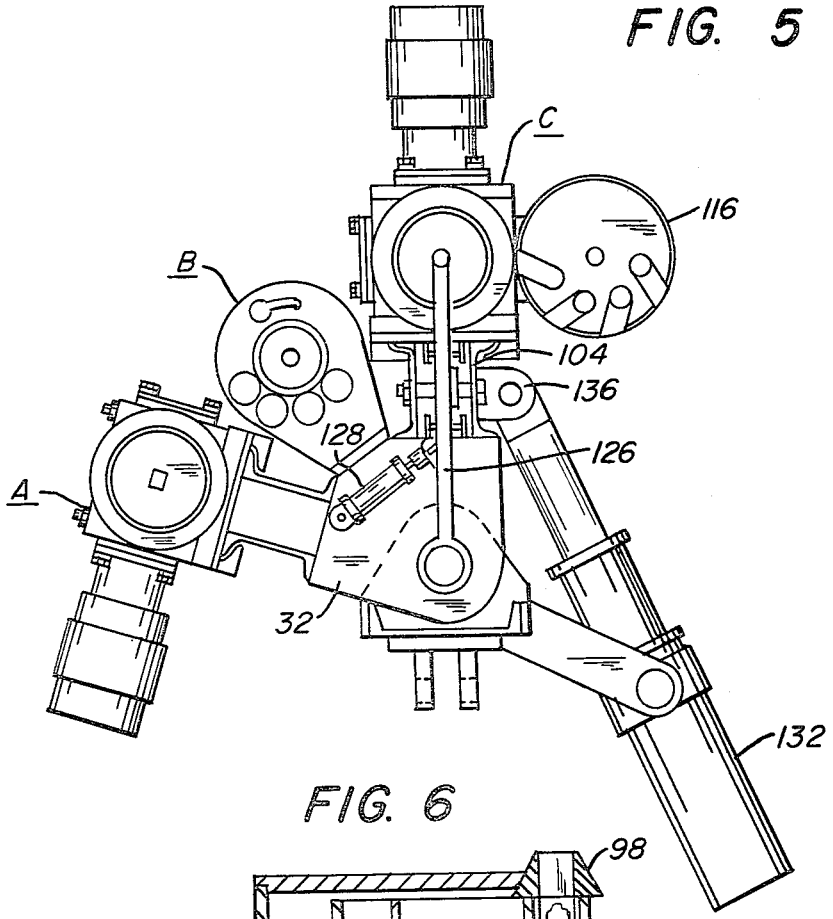
FIG. 5 is a view similar to FIG. 3 but showing the indexing apparatus of the invention in position for insertion and torquing of a bolt into a hole into which the resin cartridge has been inserted.

The details of the indexing apparatus can best be seen by reference to FIGS. 3–5. Mounted on the support members 26 for rotation about an axis 30 are plate members 32. The drilling and insertion apparatus includes a drilling station A, a resin insertion station B and a roof bolt insertion station C. With reference, first, to drilling station A, it includes a pair of channel members 34 and 36 welded to the plate members 32 and extending vertically along the length of the channel support member 22. Mounted on the forward flanges of the channels 34 and 36 for vertical sliding movement is a drill rotation unit 38, perhaps best shown in FIG. 8. It includes a right-angle drive mechanism 40 which is driven by a fluid motor 42. At the top of the right-angle drive mechanism 40 is a receptacle 44 (FIG. 3) for a drill 46 (FIG. 8) which carries a bit 48 at its upper end. Assuming that the drill 46 is fitted within the receptacle 44, rotation of the drill by the unit 38 will cause the drill to rotate about its axis. Since the unit 38 is mounted on the forward flanges of the channels 34 and 36, upward movement of the drill unit on the channels will cause the drill to move upwardly into a mine roof. During upward movement of the drill, it passes through an opening in a support arm 50 carried on the upper end of the two channels 34 and 36.

Upward or downward movement of the unit 38 and, hence, the drill 46, is effected by means of a fluid motor drive 52 (FIG. 8) connected through a sprocket 60 to a continuous chain 62 which passes around sprockets at the upper and lower ends of the channels 34 and 36, one of said sprockets 64 being shown in FIG. 3. The chain 62 is connected to the rotation unit 38 and, hence, upward movement of the forward reach of the chain upon rotation of the sprocket 60 in one direction will cause the unit 38 and drill 46 to move upwardly; whereas rotation of the sprocket 60 in the opposite direction will cause downward movement of the rotation unit and drill.

Figure 6:
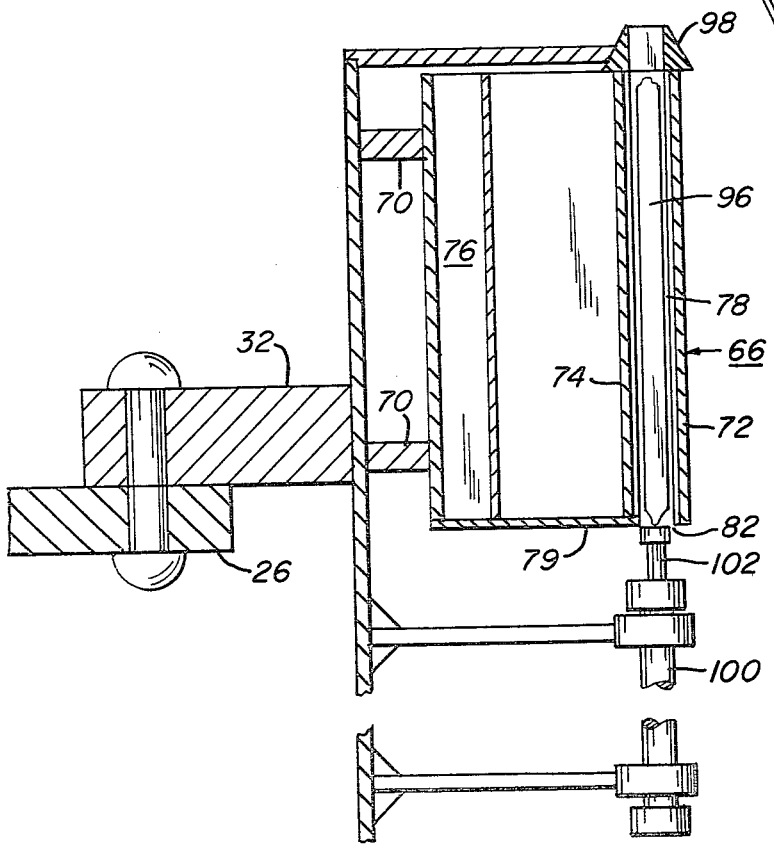
FIG. 6 is a cross-sectional view taken substantially along line VI—VI of FIG. 3 showing the details of the rotary canister for the resin cartridge and the hydraulic insertion apparatus therefor.

The details of the resin insertion station are shown in FIGS. 3, 6 and 7. It comprises a circular canister 66 supported on at least one of the plates 32. That is, the plate 32 supports an upstanding plate 68 which, in turn, supports the circular canister 66 through brackets 70. The canister 66 includes an outer circular wall 72 and an inner circular wall 74 forming an annular space 76 therebetween. Disposed within the annular space 76 is a plurality of freely-movable tubes 78 which can be forced around the annular space 76 by the mechanism of FIG. 7.

As is best shown in FIGS. 3, 6 and 7, the bottom 79 of the canister 66 is provided with an arcuate slot 80 which terminates in a generally circular area 82 having an axis which can be aligned with a hole drilled by the drill 46 upon rotation of the indexing unit. Extending upwardly through the annular slot 80 is a pawl 84 (FIG. 7) pivotally connected to a slide bar 86 and spring-biased by means of spring 88 into the position shown in FIG. 7. The slide bar 86, in turn, is connected to a hydraulic or pneumatic cylinder 90 for reciprocation along the direction of arrow 92. Since the annular space 76 is filled with the tubes 78, it will be appreciated that movement of the slide bar 86 to the right in FIG. 7 will cause the pawl 84 to engage a side of one of the tubes 78 and advance all of the tubes 78, which are in abutment with each other, around the annular space 76. In so doing, it moves one tube out of alignment with the axis of the circular opening 82 and the next successive tube into alignment with that same axis. After the tubes are thus advanced around the annular space 76, the slide bar 86 is caused to move to the left along the direction of arrow 92 in FIG. 7. In so doing, a cam surface 94 on the pawl 88 will enage the lower edge of a tube and will rotate about its pivotal connection to the slide bar 86 against the force of spring 88 until the cam surface 94 clears the end of a tube and thereafter snaps back into the position shown in FIG. 7 under the force of spring 88.

Inserted into each of the tubes 78 is a resin cartridge, one of said cartridges being shown in FIG. 6 and identified by the reference numeral 96. Each of the resin cartridges 96 comprises an outer plastic sheath or similar packaging sealed at its opposite ends and containing a resin and a catalyst which, when mixed and exposed to oxygen, will polymerize and form a solid mass. As will be seen hereinafter, when the indexing unit is rotated such that the axis of the circular opening 82 is aligned with a hole which has been drilled into a mine roof, a tapered member 98 directly above the circular opening 82 will be aligned with the drill hole also. Thereafter, a cylinder 100 carried on plate 68 is pressurized to force plunger 102 upwardly through the circular opening 82 to force the resin cartridge 96 through the opening in tapered element 98 and up into the drilled hole. Thereafter, the plunger 102 is retracted and cylinder 90 pressurized to advance the next tube 78 containing a resin cartridge into alignment with the circular opening 82.

With reference again to FIG. 3, the roof bolt insertion station C is similar to the drilling station A and includes two upright channels 104 and 106 which house a chain 108 connected to a drive unit, not shown, and to a roof bolt rotation unit 110 including a right-angle drive 112 and a fluid motor 114. Carried adjacent the rotation unit 10 is a rotary canister 116 which carries a plurality of roof bolts 118 within curved slots 120 formed about its periphery. The roof bolts 118 may, for example, be snap-fitted into the slots 120; or the slots 120 may be provided with rubber or the like fittings at their curved ends 122 to hold each drill rod in place until it is ready to be transferred onto the rotation unit 110. Assuming that the canister 116 is in the position shown in FIG. 5 and that slot 120A is in the position shown, an electromagnet 124 carried on the end of an arm 126 rotatable about axis 30 will be energized to securely clamp the drill rod 118 within the slot 120A. Thereafter, cylinder 128 is pressurized to rotate the arm 126 in a counterclockwise direction, whereupon the drill rod within slot 120A, which is now mechanically attracted to the electromagnet 124, will be rotated into alignment with a hex-head receptacle 130 on the rotation unit 110. Thereafter, the electromagnet 124 is deenergized and cylinder 128 pressurized to rotate arm 126 in a clockwise direction back into its original position.

The entire unit shown in FIGS. 3–5 can be caused to rotate about the axis 30 by means of a hydraulic cylinder 132 carried on the upright channel 22 by means of brackets 134. The piston rod of cylinder 132 is connected through a clevis 136 (FIG. 5) to the channel 104 which is, in turn, connected to the plates 32 such that when the cylinder 132 is pressurized in one direction, the entire unit shown in FIGS. 3–5 will be caused to rotate in a clockwise direction; whereas pressurization of cylinder 132 in the opposite sense will cause a counterclockwise rotation of the entire unit.

In a drilling and roof bolt insertion operation, the various stations A, B and C initially will be in the positions shown in FIG. 3 and the boom 14 manipulated to position the drill 46 beneath the location where a hole is to be drilled. Thereafter, the drive unit 52 (FIG. 8) is energized as is the rotary drive unit 38 for the drill 46. This causes the drill 46 to rotate and move upwardly, thereby forming a drilled hole in the mine roof.

After the hole is thus formed in the mine roof, the drill 46 is lowered and cylinder 132 is pressurized to rotate the stations A, B and C into the positions shown in FIG. 4 wherein a tube 78 in the canister 66 is aligned with the hole just drilled. Cylinder 100 is now pressurized to force the resin cartridge 96 upwardly into the drilled hole. Normally, flexible tabs are provided at the upper end of the cartridge 96 to temporarily hold it within the drilled hole. As the plunger 102 is retracted into the position shown in FIG. 6, cylinder 90 is actuated in the manner described above to advance the next, filled, tube into alignment with the circular opening 82 preparatory to a succeeding filling operation.

As this juncture, the cylinder 132 is again pressurized to move the stations A, B and C into the positions shown in FIG. 5 wherein a roof bolt 118 has been transferred from the canister 116 into alignment with the hex opening 130 in the drive unit 110. As soon as the roof bolt has been transferred into alignment with the hex opening 130, the electromagnet 124 deenergizes and the arm 126 rotated backwardly into its original position. A drive unit for chain 108, not shown but similar to unit 52 of FIG. 8, is then actuated to elevate drive unit 110 and the roof bolt carried thereby. At the same time, fluid motor 114 rotates the roof bolt. As the roof bolt moves upwardly, it will engage the previously-deposited resin-filled cartridge 96. In so doing, it punctures the cartridge, mixes the resin with the catalyst therein and forces the resin outwardly and downwardly around the roof bolt as it moves upwardly into the drilled hole. When the roof bolt is completely inserted into the drilled hole and the resin distributed therearound, the drive unit 110 is lowered on the channels 104 and 106. The roof bolt, of course, will remain in the drilled hole since the resin quickly cures; and since a plate is carried on the bottom of the roof bolt as is conventional, support for the mine roof is provided.

The unit is now ready to execute a new drilling, resin insertion and roof bolt insertion operation. To accomplish this, the cylinder 132 is pressurized in the opposite sense to cause the plates 32 and stations A, B and C to rotate in a clockwise direction about the axis 30 until all stations reach the position shown in FIG. 3 where a new drilling operation can begin.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. Mine roof bolting apparatus comprising support means, an indexing device mounted on said support means for rotation about an axis extending parallel to a roof bolt to be inserted into a mine roof, drilling apparatus carried on said indexing device and adapted to force a drill up into the mine roof to form a drilled hole for the reception of a roof bolt, resin cartridge insertion apparatus carried on said indexing device and adapted to insert a resin cartridge into a drilled hole in the mine roof, roof bolt insertion apparatus carried on said indexing device and adapted to insert a roof bolt into a hole which has been drilled in the mine roof, and apparatus for actuating said indexing device to initially index a drill into alignment with the axis of a hole to be drilled and thereafter index said cartridge insertion device and said roof bolt insertion apparatus into alignment with the drilled hole.

2. The apparatus of claim 1 wherein said resin cartridge insertion apparatus includes a canister containing a plurality of resin cartridges each of which may be forced upwardly into a drilled hole in succession.

3. The apparatus of claim 1 wherein said roof bolt insertion apparatus includes a magazine for carrying a plurality of roof bolts which are successively forced upwardly into a succession of drilled holes.

4. The apparatus of claim 2 wherein said canister comprises coaxial inner and outer annular walls defining a generally annular space therebetween, and a plurality of tubular elements circumferentially spaced around said annular space, each of said tubular elements being adapted to contain a resin cartridge.

5. The apparatus of claim 4 including fluid cylinder means located at a point around said canister for forcing a resin cartridge in an associated tubular element up into a hole which has been drilled in a mine roof.

6. The apparatus of claim 5 including means for advancing said tubular elements around said annular space.

7. The apparatus of claim 5 wherein said fluid cylinder means associated with said canister is radially spaced from the axis of rotation of the indexing device in an amount equal to the radial spacing of a drill on said drilling device from said axis of rotation.

8. The apparatus of claim 7 wherein a roof bolt positioned on said roof bolt insertion device is radially spaced from the axis of rotation of the indexing device in an amount equal to the radial spacing of both said canister fluid cylinder means and a drill on said drilling device.

9. The apparatus of claim 3 wherein said magazine includes a rotary canister having a plurality of roof bolts disposed about its periphery, means for rotating said canister, and means for transferring successive ones of said roof bolts from said canister to said roof bolt insertion device.

* * * * *